US006999383B1

(12) United States Patent
Wang et al.

(10) Patent No.: US 6,999,383 B1
(45) Date of Patent: Feb. 14, 2006

(54) CLOCK WITH LUMINOUS HANDS

(76) Inventors: Chine-Fu Wang, 2F, No. 208, Wenhua Rd., Yungho City, Taipei Hsien (TW); Cheng-Ming Kuo, No. 243, Chungcheng Rd., Chunan Chen, Miaoli Hsien (TW)

( * ) Notice: Subject to any disclaimer, the term of this patent is extended or adjusted under 35 U.S.C. 154(b) by 2 days.

(21) Appl. No.: 10/909,373

(22) Filed: Aug. 3, 2004

(51) Int. Cl.
*G04B 19/06* (2006.01)

(52) U.S. Cl. ..... 368/228; 368/238

(58) Field of Classification Search ..... 368/226–228, 368/238, 241, 242, 80, 83, 84, 67, 68
See application file for complete search history.

(56) References Cited

U.S. PATENT DOCUMENTS 5,623,456 A * 4/1997 Miyamoto et al. ..... 368/226
5,697,322 A * 12/1997 Hay et al. ..... 116/286
5,797,345 A * 8/1998 Evans et al. ..... 116/286
6,793,381 B1 * 9/2004 Marsh ..... 362/377

* cited by examiner

*Primary Examiner*—Kamand Cuneo
*Assistant Examiner*—Thanh S. Phan
(74) *Attorney, Agent, or Firm*—Dennison, Schultz, Dougherty & MacDonald

(57) ABSTRACT

A clock with luminous hands has a clock panel with a front clock surface and a rear surface to which a hand-driving assembly and a power inverter are mounted. The hand-driving assembly has a pin protruding through the clock panel and extending from the front clock surface. An hour hand and a minute hand both formed by single-pole CCFLs are mounted around the pin with one end. When the power inverter produces a high voltage conducting to the pin, both the hands are energized to generate light.

6 Claims, 5 Drawing Sheets

CLOCK WITH LUMINOUS HANDS

BACKGROUND OF THE INVENTION

1. Field of the Invention

The present invention relates to a clock with luminous hands, and particularly relates to a clock using single-pole cold cathode fluorescence lamps (CCFL) as the luminous hands.

2. Description of Related Art

Luminous clocks are quite convenient for users to easily recognize what time it is, especially in dark circumstances. Such a luminous function is often seen from electrical clocks with a digital display, rather than traditional analog clocks. In the analog clock, because its hands are rotatably mounted on the same axis, when connecting power lines to the axis, negative and positive power lines are easily tangled together as the hands rotate to result in an abnormal short circuit. To solve the short circuit problem, luminous paint is applied on the hands of the clock thereby achieving the purpose of luminescence. However, the effective luminous life-span of the paint is very short. The intensity of light generated by the luminous paint will gradually decrease and finally become dark and unrecognizable.

Therefore, the invention provides a clock with luminous hands to mitigate or obviate the aforementioned problem.

SUMMARY OF THE INVENTION

The main objective of the present invention is to provide a clock with luminous hands formed by single-pole cold cathode fluorescence lamps (CCFL) to which a high voltage is supplied for actuation without using positive/negative power lines to avoid the problem of a short circuit.

To accomplish the objective, the clock with luminous hands utilizes:

- a panel having a rear surface and a front clock surface, wherein a hand-driving assembly with a pin protruding from the front clock surface is mounted at the rear surface;
- a hand assembly comprising at least one hand formed by a single-pole cold cathode fluorescence lamp (CCFL) with one end electrically mounted around the pin; and
- an inverter attached to the rear surface of the panel to supply a high voltage conducting to the pin thus energizing the at least one hand to generate light.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
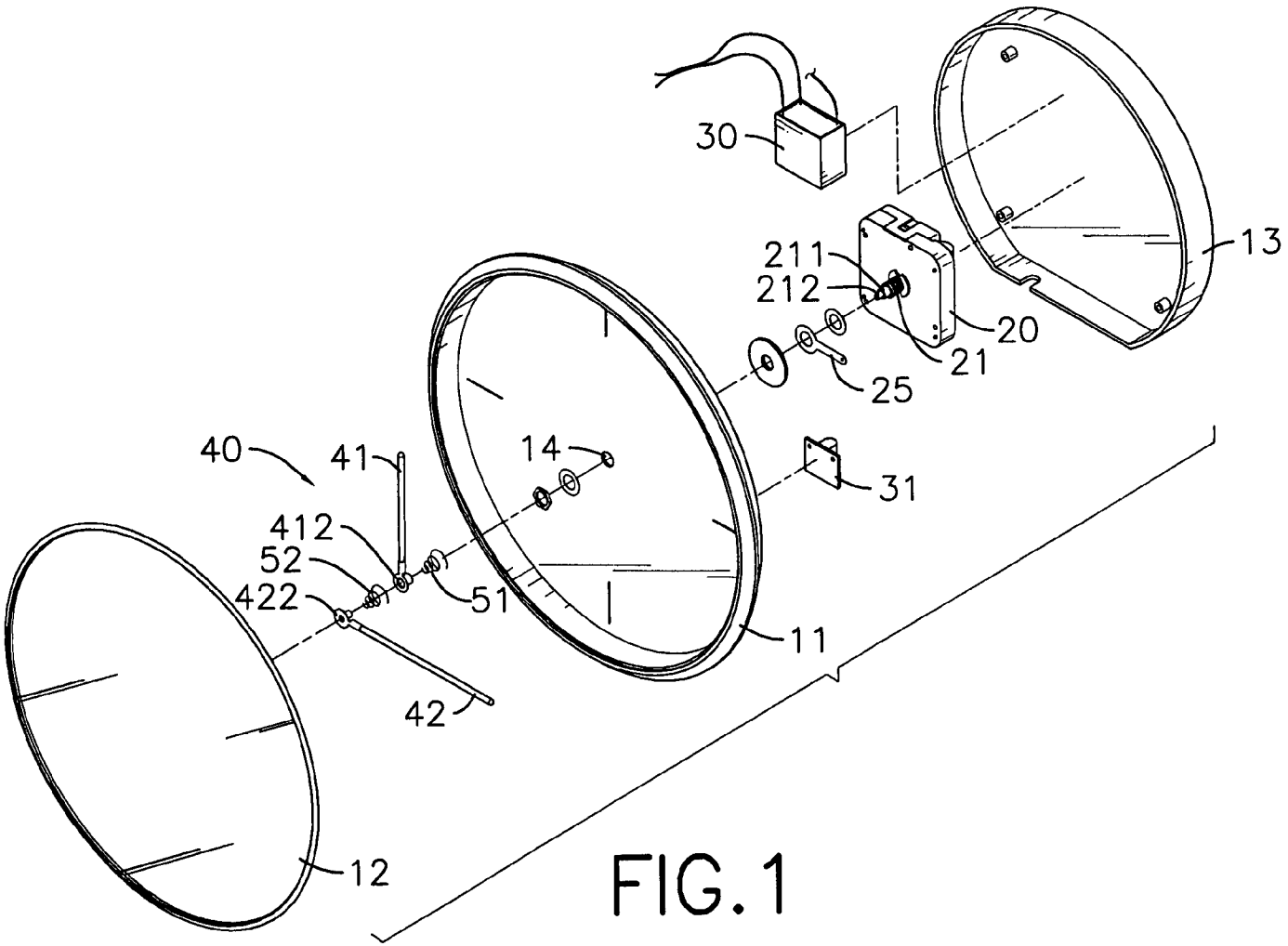
FIG. 1 is an exploded perspective view of a clock in accordance with the present invention.
Figure 2:
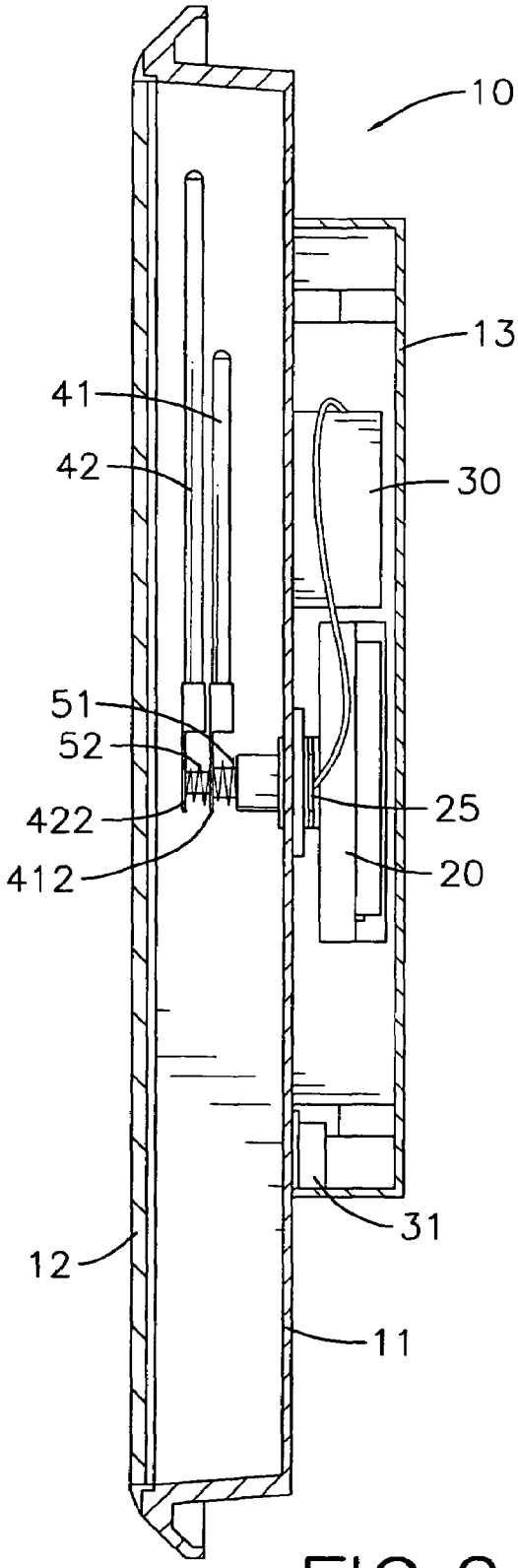
FIG. 2 is a cross sectional view of the clock in accordance with the present invention.

With reference to FIGS. 1–2, a clock in accordance with the present invention has a body (10) comprising a panel (11) with a rear surface and a clock surface to which a rear cover (13) and a transparent plate (12) are respectively attached. Any kind of recognizable numerals, symbols or scales for indicating time are formed on the clock surface of the panel (11). A hole (14) is defined at a center of the panel (11). When the rear cover (13) attaches to the rear surface, a chamber is defined between the rear cover (13) and the panel (11) to receive a hand-driving assembly (20) therein.

The hand-driving assembly (20) with a rotatable pin (21) protruding through the hole (14) is mounted at the rear surface of the panel (11). The pin (21) integrally forms two coaxial portions (211)(212) with different diameters, wherein the second portion (212) extends from the first portion (211) and has the smaller diameter. A conductive plate (25) defines an aperture that allows the pin (21) extend therethrough so that the conductive plate (25) can be mounted between the rear surface of the panel (11) and the hand-driving assembly (20).

An inverter (30) is securely disposed in the chamber, and is preferably mounted on the rear surface of the panel (11) to generate a high voltage.

Figure 3:
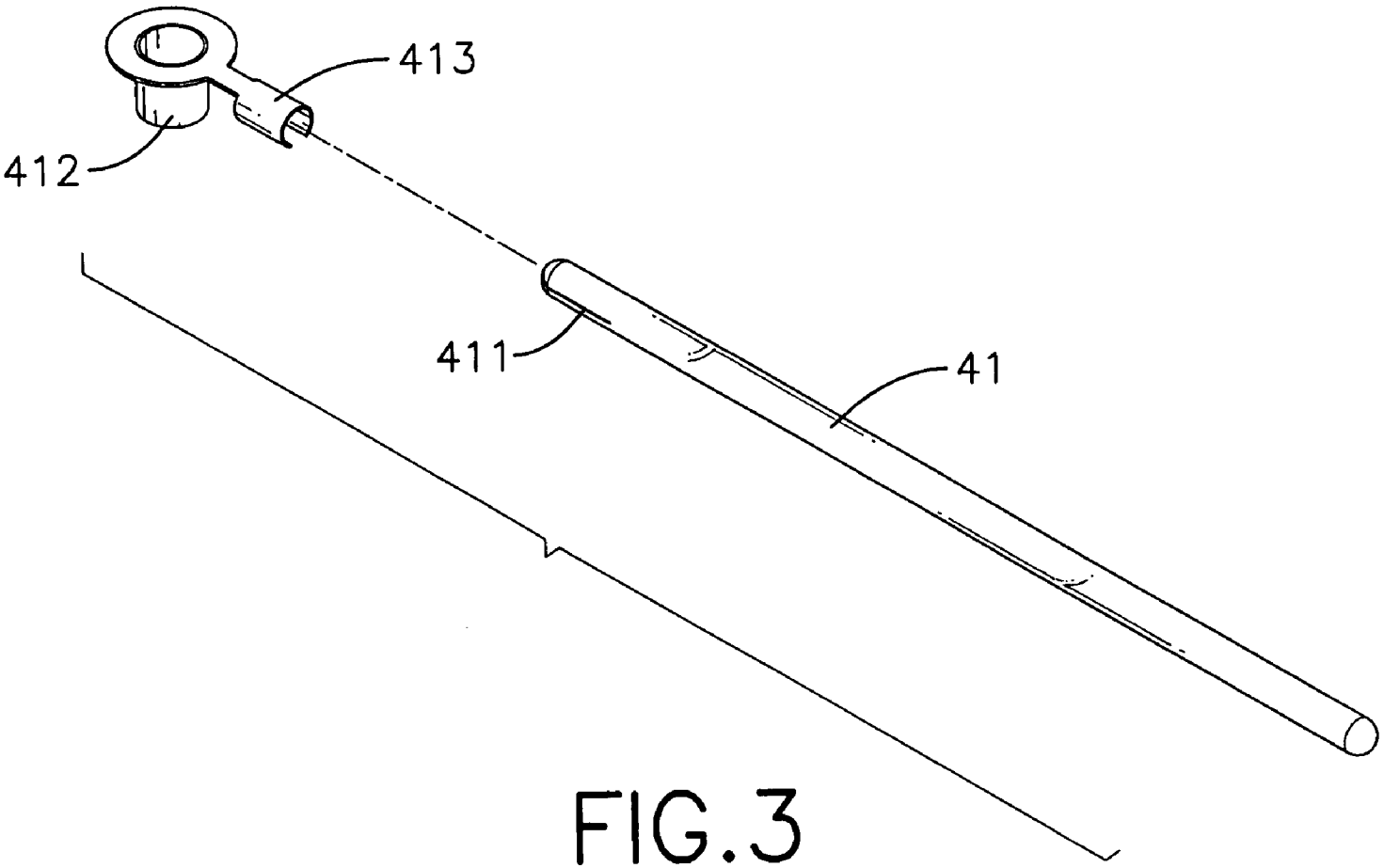
FIG. 3 is an exploded perspective view of a luminous hand in accordance with the present invention.

A hands assembly (40) comprises an hour hand (41) and a minute hand (42). Either the hour hand (41) or the minute hand (42) is formed by a single-pole cold cathode fluorescence lamp (CCFL). With reference to FIG. 3, using the hour hand (41) as an example, only one pole terminal (411) of the CCFL is exposed and extends from one end of the lamp. A conductive cap (412) is formed by a circular ring (not numbered) with a center hole, a sleeve extending downward from the edge of the center hole, and an arc plate (413) extending from the circular ring to enclose the pole terminal (411). The architecture of the minute hand is the same as the hour hand, the only change is that the sleeve of the minute hand is smaller than that of the hour hand to correspond to the second portion (212) of the pin (21).

Still referring to FIGS. 1–2, when assembling the hands assembly (40) to the clock body (10), the pin (21) protruding from the hole (14) is firstly secured with a nut and a washer. A first spiral spring (51) then is mounted around the first portion (211) of the pin (21). After the hour hand (41) attaches to the pin (51), the conductive cap (412) presses against and is surrounded by the first spiral spring (51), and the sleeve of the conductive cap (412) is mounted around the first portion (211). A second spiral spring (52) is subsequently mounted around the second portion (212) of the pin (21). The minute hand (42) with its sleeve then mounts around the second portion (212) and presses against the second spiral spring (52) that surrounds the sleeve.

Figure 4:
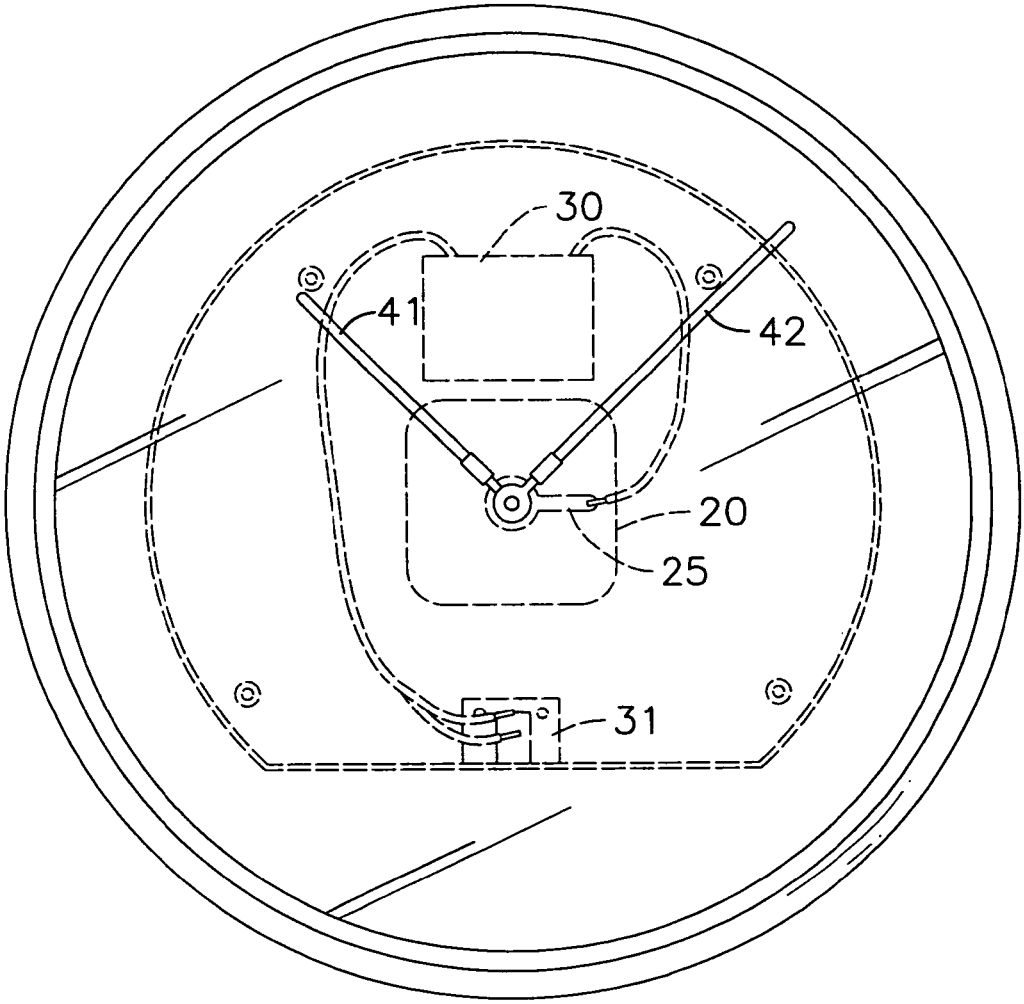
FIG. 4 is a plan view showing an electricity supply manner of the luminous hands.

With reference to FIG. 4, the inverter (30) receives an input power from a power socket (31) coupled to a DC transformer (not shown). The inverter (30) provides only one output terminal to output a high voltage, preferably 1000V/65 mA. The output terminal is coupled to the conductive plate (25) via a wire, whereby the high voltage is able to be conducted to the washer, the nut, the first spiral spring (51), the second spiral spring (52) and the caps (412)(422) of the two hands (41)(42). Since each cap (412)(422) is electrically contacted with the pole terminal (411) of the CCFL, the CCFL can be activated by the high voltage to generate light. In more detail, when the high voltage energizes the CCFL, inert gases in the CCFL cause an ionization reaction to generate ultraviolet radiation.

When the ultraviolet radiation irradiates on the fluorescent material coated on the inner side of the CCFL, fluorescent light is emitted.

Figure 5:
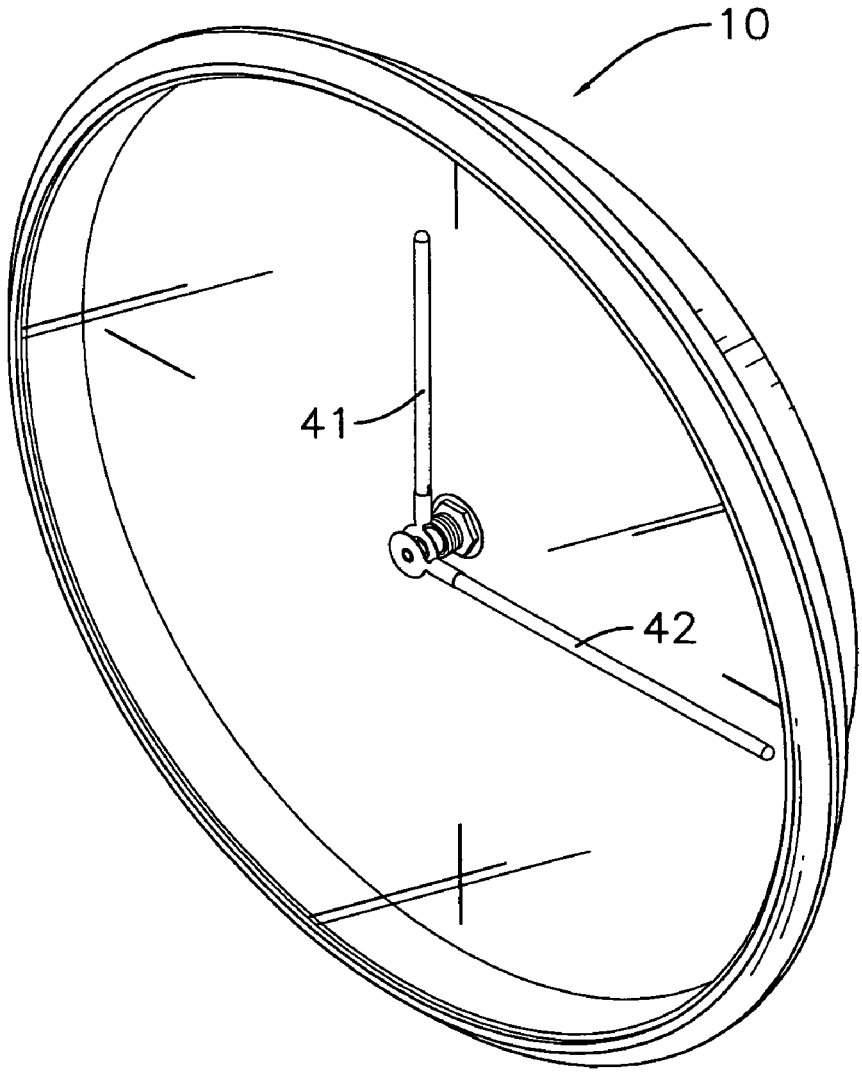
FIG. 5 is a perspective view of the clock in accordance with the present invention.

With reference to FIG. 5, when in use, the hands (41)(42) of the clock in accordance with the present invention continuously generate visible light. For a user who looks at the clock in dark circumstances, the time can be easily determined. Further, by using different CCFLs coated with different fluorescent material of colors, the different hands can be very easily identified.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A clock with luminous hands, the clock comprising:

a panel having a rear surface and a front clock surface, wherein a hand-driving assembly with a pin protruding from the front clock surface is mounted at the rear surface;

a hand assembly comprising at least one hand formed by a single-pole cold cathode fluorescence lamp (CCFL) with one end electrically mounted around the pin; and an inverter attached to the rear surface of the panel to supply a high voltage conducting to the pin thus energizing the at least one hand to generate light.

2. The clock as claimed in claim 1, wherein the hand assembly comprises an hour hand and a minute hand and each of the hands is formed by the single-pole CCFLs.

3. The clock as claimed in claim 2, wherein a pole terminal is exposed and extends from one end of each CCFL, and a conductive cap is attached to and electrically contacted with the end having the pole terminal.

4. The clock as claimed in claim 3, wherein the pin of the hand-driving assembly forms two coaxial portions with different diameters, wherein the conductive caps of the hour hand and the minute are mounted around a respective one of the two coaxial portions of the pin.

5. The clock as claimed in claim 4, wherein the pin protruding from the front clock surface is secured by a nut, wherein the hand assembly further comprises:

a first spiral spring mounted around the first portion so that when the conductive cap of the hour hand is mounted around the pin, the conductive cap presses against and is surrounded by the spiral spring; and a second spiral spring mounted around the second portion so that when the conductive cap of the minute hand is mounted around the pin, the conductive cap presses against and is surrounded by the second spring.

6. The clock as claimed in claim 5, wherein a conductive plate is mounted around the pin behind the rear surface of the panel to electrically connect to the inverter via a wire.

* * * * *